United States Patent [19]

Bergstrom

[11] 4,129,113

[45] Dec. 12, 1978

[54] COMBINATION GLASS DOOR AND HEAT-EXCHANGING GRATE FOR FIREPLACES

[75] Inventor: Theodore R. Bergstrom, St. Paul, Minn.

[73] Assignee: Thermograte, Inc., St. Paul, Minn.

[21] Appl. No.: 782,623

[22] Filed: Mar. 30, 1977

[51] Int. Cl.[2] ..... F24B 7/00

[52] U.S. Cl. ..... 126/121; 126/202; 165/174; 285/187; 285/223

[58] Field of Search ..... 126/99 A, 109, 121, 126/140, 164, 165, 202; 165/82, 174; 285/187, 223, 224, 225

[56] References Cited

U.S. PATENT DOCUMENTS

| | | | |
|---|---|---|---|
| 1,747,259 | 2/1930 | Pierce | 126/121 |
| 2,743,720 | 5/1956 | Dollinger | 126/121 |
| 3,901,212 | 8/1975 | Stites | 126/121 |
| 4,008,734 | 2/1977 | Shimono et al. | 285/224 X |
| 4,018,210 | 4/1977 | Christophel | 126/164 |
| 4,072,327 | 2/1978 | Young | 285/187 X |

FOREIGN PATENT DOCUMENTS

| | | | |
|---|---|---|---|
| 354485 | 7/1905 | France | 126/121 |
| 639468 | 3/1928 | France | 126/121 |
| 1004182 | 11/1951 | France | 126/121 |
| 908806 | 10/1962 | United Kingdom | 165/174 |

OTHER PUBLICATIONS

"Dual Action Fireplace Furnace," Stone Castle, Inc., 6160 - 90th Ave. S.E., Mercer Is., Wash. (11/22/76).

*Primary Examiner*—Martin P. Schwadron
*Assistant Examiner*—Richard Gerard
*Attorney, Agent, or Firm*—Merchant, Gould, Smith, Edell, Welter & Schmidt

[57] ABSTRACT

An improved combination glass door closure and ducted (e.g., tubular) heat exchanging grate for fireplaces. The combination grate includes a ducted heat exchanger suitable for positioning within a fireplace cavity. The heat exchanger comprises a plurality of hollow, generally parallel, C-shaped heat exchanger members which are carried by a glass door fireplace closure. One end of each of the heat exchanger members is attached to the fireplace closure by means of a sliding or floating seal and means are provided for preferentially directing the flow of air to the centermost heat exchanger members.

13 Claims, 9 Drawing Figures

FIG.7
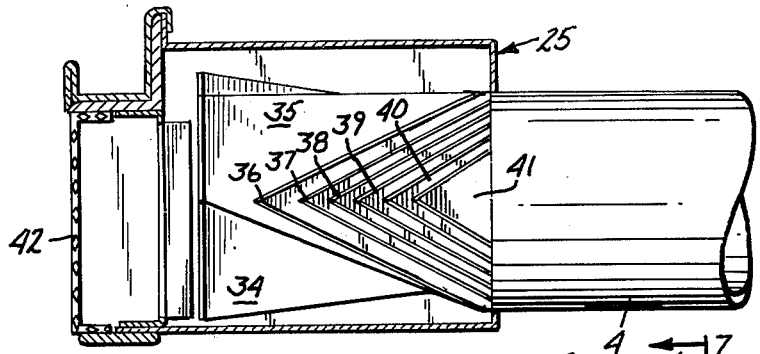
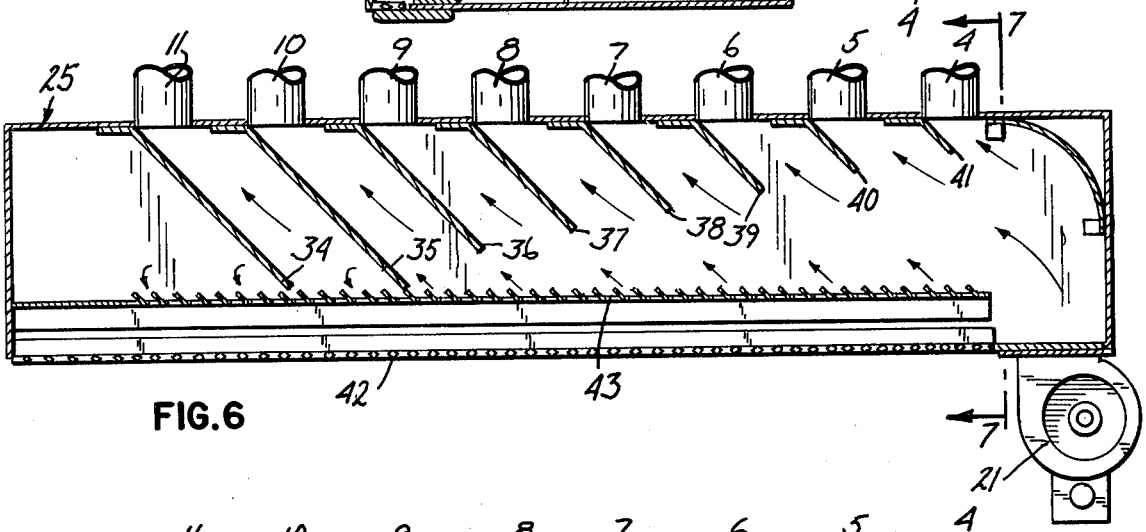
FIG.6
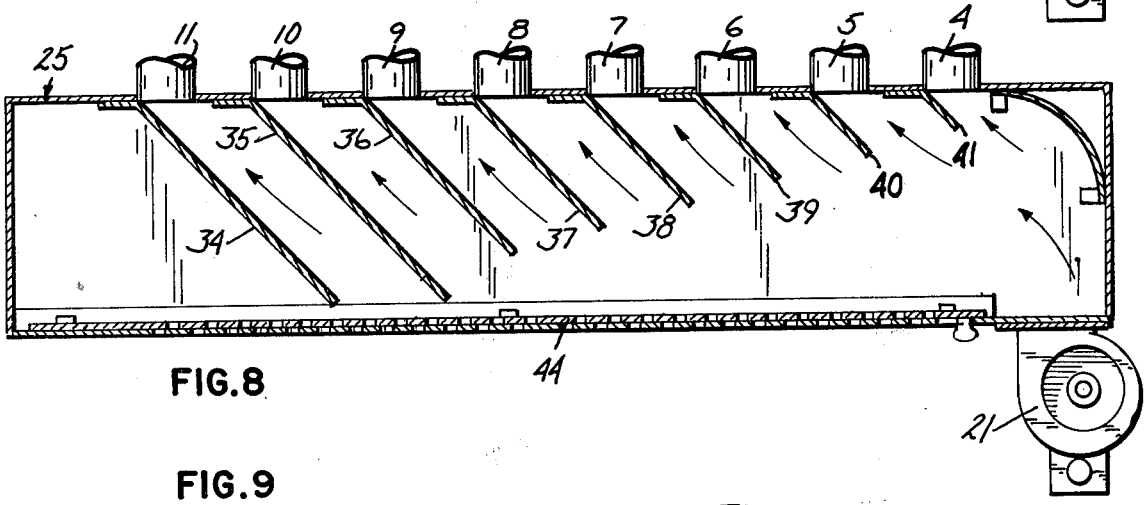
FIG.8
FIG.9
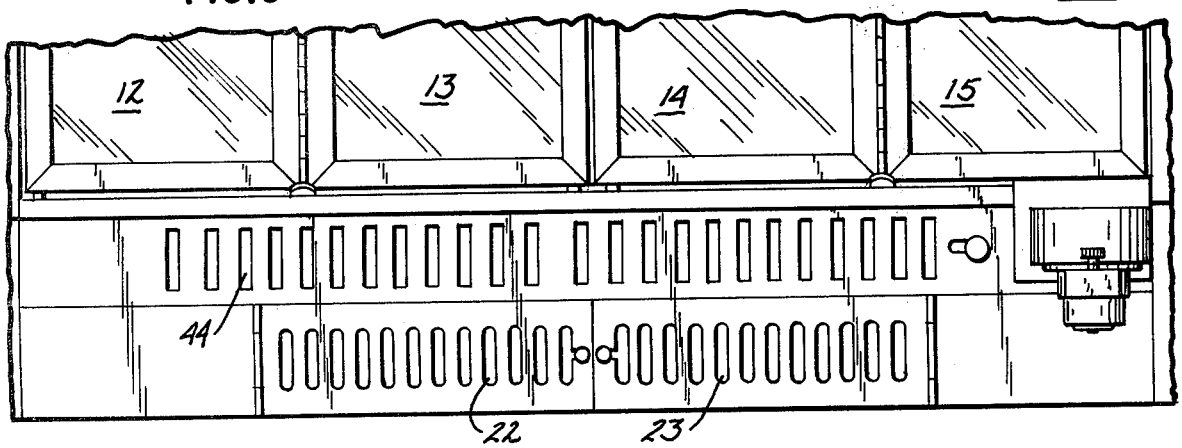

COMBINATION GLASS DOOR AND HEAT-EXCHANGING GRATE FOR FIREPLACES

BACKGROUND OF THE INVENTION

Fireplaces have been used for many years for heating, cooking, and aesthetic reasons.

In modern homes and buildings, the heating function of fireplaces has been relatively unimportant because more effective alternative heating systems (e.g., centrally located forced air furnaces) are in widespread use. However, there are some situations in which the heating function of fireplaces is of significant importance. For example, in some small vacation cottages fireplaces are the only means available for providing heat.

Recent shortages of energy and the escalating costs of fuel have caused increased attention to be focused upon apparatus and methods for improving the heating efficiency of fireplaces, whether located in small buildings or cottages having no central heating system, or located in homes or other buildings having a central heating system.

Heat transmission from fireplaces can be divided into three categories:

1. Conduction
2. Convection
3. Radiation

With a typical open-front fireplace equipped with a cast iron fireplace grate, there is very little useful heat gain by conduction. Further, there is essentially no heat gain due to convection. In fact, room air is actually drawn into the fireplace and exhausted up the chimney during the time that a fire is burning in a fireplace. Consequently, there is actually a net loss of warm air from a room when a fire is burning in such a fireplace. For these reasons, substantially all of the heating effect of an open-front fireplace equipped with conventional cast iron or wrought iron grate results from radiant heat. This radiation travels through the room air, but has virtually no effect in warming the air as the radiation passes through the air. However, when radiant heat strikes a solid object such as a person, it does warm the object. It is extremely difficult to be precise in measuring the radiant heat output from fireplaces. However, it can generally be noted that the radiation of heat from a fire will vary considerably depending upon the type of fuel used, the size and temperature of the bed of coals, the distance between the fire and the object being heated by radiation, etc.

In an effort to reduce the loss of warm room air through open-front fireplaces, glass door closures have been used. These have the effect of substantially reducing, although not elminating, the loss of room air through the chimney. Since the glass door closure becomes hot, some minor convective heat output is generated by air currents within the room which come in contact with the room side of the glass closure. However, these convective heat gains tend to be offset by a decrease in the amount of heat radiated from the fire. This decrease is a result of radiant heat being reflected by the glass back into the fireplace.

In the interest of improving the heating efficiency of open-front fireplaces, tubular fireplace grates have been developed which provide heat to the room in which the fireplace is located in the form of convective heat output through the tubes. One popular design of such a tubular fireplace grate is shown in U.S. Design Pat. No. 228,728.

More recently, products have begun to appear on the market which combine the desirable features of a tubular or ducted heat-exchanging fireplace grate with a glass door closure. Combination products of this type reduce room air losses through the fireplace while increasing convective heat output through the tubes and from the face of the glass door closure. Such combinations of glass doors and grates have improved heating efficiencies, but their design has been accompanied by certain structural problems due to uneven expansion and contraction of the various component parts during heating and cooling, uneven heat distribution, and other problems.

SUMMARY OF THE INVENTION

The present invention is an improved combination glass door closure and ducted (e.g., tubular) heat exchanging grate for fireplaces. Preferred combination units include design features that reduce the effect of differential thermal expansion and contraction between the glass door closure and the ducted heat exchange members which operate in direct contact with the fire and/or provide for controlled air distribution.

Briefly described, the improved combination glass door and heat exchanging grate for fireplaces comprises a plurality or ducted or hollow, generally parallel C-shaped heat exchanger members (e.g., tubes) which are mounted for location within the fireplace cavity or fire chamber. The open ends of these heat exchanger tubes communicate through the glass door closure to allow room air to be drawn into the lower tube openings. The air is heated within the tubes while in the fireplace cavity and the heated air is then exhausted from the upper ends of the tubes back into the room. In contrast to prior art combinations of this general type, the combination fireplace grates of the present invention do not provide for a rigid attachment of the hollow or ducted heat exchange members at both of their ends to the closure portion of the combination grate. Instead, the upper or the lower or both upper and lower ends of the tubular heat exchange members are attached to the front face of the closure in a floating or sliding seal relationship so that the hollow heat exchange members can open or yawn in response to heating and close or contract on cooling without distorting the front face of the fireplace closure or otherwise damaging the combination grate.

In addition, the improved combination glass door and fireplace grate of the present invention preferably includes an air distribution system for ducting room air into the lower tube openings, either through natural convection or by forced air circulation with a blower assist. Preferably, the unit will permit the controlled use of a combination of natural convection and blower assisted (e.g., a variable speed blower) air for heating purposes. Although outside air (i.e., non-room air) can be ducted into the heat exchange system, it is preferred to use room air which enters the tubular heat exchanger through a manifold located in the lower portion of the combination grate. This manifold can include manually operated louvers for controlling the amount of air moving by natural convection into the tubes. Further, a blower is optionally provided which is in communication with the manifold and can be used to supplement or replace the natural convection of room air through the heat exchanger tubes. Desirably, the manifold will be designed so that air can enter the heat exchanger tubes regardless of whether or not the optional blower is operating and regardless of the blower operating speed. It is particularly preferred to use a blower that has a rheostat-type control to give a continuous speed range so that air and noise levels can be selected. Finally, the manifold desirably includes means for distributing the air, particularly blower introduced air, in such a way that the tubes in the center of the fireplace receive a greater amount of air than they wuld receive if all tubes were fed on a demand or natural basis. This serves to increase the operating efficiency of the combination grate and may provide a more uniform discharge of heated air into the room. This occurs because the center tubes tend to be the hottest and more useful heat can be extracted from the fireplace cavity by circulating more air to the hottest heat exchanger tubes. Without such air distributing means, air from a side-mounted blower tends to preferentially enter the heat exchanger tubes furthest from the blower.

Combustion air can be introduced into the fireplace cavity through louvers mounted in the ash removal doors of the closure or can be directed into the fireplace cavity from some outside source.

THE DRAWINGS

FIG. 6 is a cross-sectional view of the air manifold of the combination grate of FIG. 2 as taken along the line 6—6 in the direction of the arrows.

FIG. 7 is a cross-sectional view of the air manifold shown in FIG. 6 as taken along the line 7—7 in the direction shown by the arrows.

FIG. 8 is a view similar to FIG. 6 but showing a different embodiment in which the air flow regulating vanes have been omitted.

FIG. 9 is a fragmentary view in front elevation showing the lower portion of the glass door closure.

DETAILED DESCRIPTION

The present invention is a combination glass door closure and ducted or hollow (e.g., tubular) fireplace grate.

Figure 1:
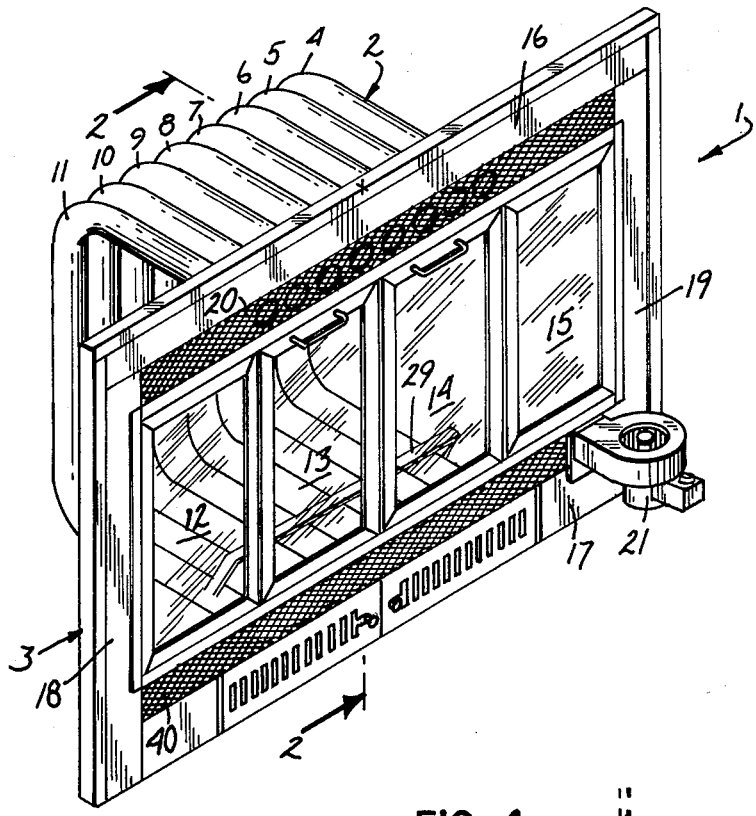
FIG. 1 is a view in perspective of a heat saving, combination glass door and heat exchanging fireplace grate as seen from the top, front, and one end.

As shown in FIG. 1, the combination grate is generally represented by the numeral 1. It includes a hollow or tubular heat exchanger generally designated by the numeral 2 which is attached to a glass door fireplace closure generally designated by the numeral 3.

The tubular heat exchanger portion of the combination unit includes a plurality of hollow or ducted heat exchange members 4–11 which are secured in some fashion (e.g., welding) to the fireplace closure 3. The number of heat exchange members is not critical. However, for any given size of fireplace opening, there is a practical limit to the number and size of heat exchange members which can be used. Since the purpose of the heat exchange members is to allow room air to be drawn into the bottom openings of the heat exchange members, permit the air to be heated by the hot heat exchange members, and allow the hot air to be ejected or discharged from the upper ends of the heat exchange members, the members must be hollow or ducted. A variety of shapes and cross-sections can be used for the heat exchange members (e.g., square, oval, triangular, finned, etc). However, it has been found convenient to use hollow tubes having a generally circular cross-section, usually with a diameter within the range of 2–8 (e.g., 3–6) centimeters. It is customary to space the tubes apart, usually at a common distance (e.g., 1–6 cm) so that combustion gases can be exhausted between the tubes through the fireplace chimney and ashes can drop to the floor of the fireplace cavity.

For convenience, the present invention is hereinafter described by referring to the heat exchange members as "tubes" since that style and shape of heat exchange member is preferred.

The fireplace closure 3 as shown in FIG. 1 will comprise one or more glass doors. As shown in FIG. 1, four glass panels 12–15 are connected together in pairs to form two doors of the bi-fold type. As shown in FIG. 1, these glass panels or doors are carried by and suspended from the closure frame which includes top panel 16, bottom panel 17, and side panels 18 and 19, each of which is formed from a plurality of separate parts.

As shown in FIG. 1, the upper ends of heat exchanger tubes 4–11 are secured to and communicate through the upper panel 16 of the fireplace closure. Further, the open upper ends of the heat exchanger tubes 4–11 are desirably covered with an expanded metal screen 20 for decorative and safety reasons.

The lower ends of heat exchanger tube 4–11 are secured to the lower panel 17 of fireplace closure 3. Although it is not essential, it is preferred that the lower ends of heat exchanger tubes 4–11 be in communication with or otherwise connected with an air distribution manifold which is capable of receiving room air by natural convection, or forced air (e.g., air forced into the system by means of blower 21), or a combination of natural convective air and forced air. The details of a suitable air distribution manifold are shown in FIGS. 2 and 5–8.

The lower panel 17 of fireplace closure 3 optionally and preferably includes manually operated draft regulators or ventilators 22 and 23 which allow the regulation of room air into the fireplace cavity to assist in combustion of the fuel being consumed. Panels containing such ventilators can be hinged to permit ash removal.

Figure 2:
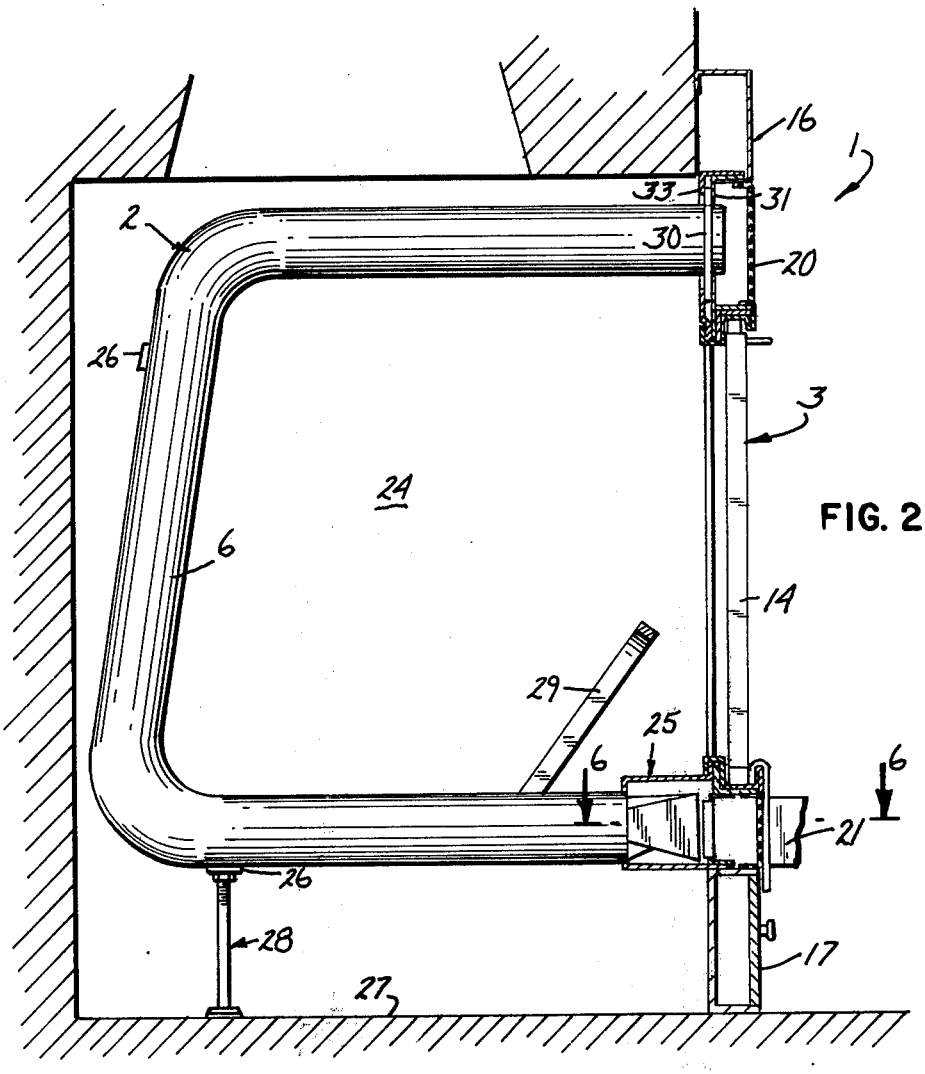
FIG. 2 is a cross sectional view of the combination grate shown in FIG. 1 as taken along the line 2—2 in the direction of the arrows. For convenience, this cross-sectional view also shows the surrounding fireplace cavity (not shown in FIG. 1).

FIG. 2 is a view in side elevation of the combination unit of FIG. 1 as taken along the plane 2—2 in the direction of the arrows. As shown in FIG. 2, the tubular heat exchanger 2 which includes the heat exchanger tube 6 is positioned within fireplace cavity 24. The upper end of generally C-shaped heat exchanger tube 6 is connected to upper panel 16 of the fireplace closure 3 while the lower end of heat exchanger tube 6 is connected to lower panel 17 of fireplace closure 3 through air distribution manifold 25. If desired, one or more of the heat exchanger tubes can be (and preferably will be) interconnected by means of one or more reinforcing straps 26. The tubular heat exchanger can be supported above the floor 27 of fireplace cavity 24 (sometimes called the "fire chamber") with one or more adjustable legs 28. Alternatively, the heat exchanger 2 can be positioned within fireplace cavity 24 and supported merely by fireplace closure 3 which can be attached to the fireplace by means of bolts, straps, or other fastening devices (not shown).

The heat exchanger tubes 4–11 may be provided with a log retaining strap 29 or similar functioning device to allow logs which are placed between the retaining strap 29 and the generally vertical portion of heat exchanger tubes 4–11 to remain in a proper burning position and prevent the logs from inadvertently rolling out of the fireplace through the front of fireplace closure 3 when the glass doors are opened.

If the ends of heat exchanger tubes 4–11 are not substantially sealed to the fireplace closure, the reduced air pressure within the fireplace cavity 24 (during combustion) may tend to pull large quantities of heated air (e.g., from the room or from the heat exchanger tubes) back into the fireplace cavity with resulting heat loss. Consequently, the tubes are usually sealed to the fireplace closure by welding, etc. and air for combustion is permitted to enter the fireplace cavity in controlled amounts, either as room air through draft regulators 22 and 23 or as outside air ducted into the fireplace cavity (not shown).

Experience has shown that if the upper ends and the lower ends of heat exchanger tube 4–11 are all rigidly connected to fireplace closure 3 (e.g., connected by welding), the combination units tend to become distorted or break after repeated use. These problems apparently arise because the distance between the upper and lower ends of each tube tend to increase or decrease as the tube is heated or cooled (i.e., the heat exchanger tubes "yawn") and this expansion does not match the thermal expansion and contraction of fireplace closure 3. This differential in expansion and contraction results in undesirable stresses which sometimes produce distortion of the fireplace closure 3, crack the welds where the heat exchanger tubes are joined to the fireplace closure 3 or otherwise damage the units. These stress problems are more troublesome when the tubes are made of stainless steel (desired because of high strength, and long useful life) rather than mild steel because of the much greater thermal expansion and lower thermal conductivity of stainless steel. To minimize or avoid these problems, either the upper ends or the lower ends or both ends of the heat exchanger tubes should be joined to the fireplace closure 3 by means of a floating or sliding seal to allow for the different rates of expansion and contraction. It is preferred to use floating or sliding seals for connecting the top ends of the heat exchanger tubes 4–11 to the fireplace closure 3 and to employ a permanent or rigid connection for attaching the lower ends of the heat exchanger tubes to the fireplace closure 3. This permits the lower ends of the tubes to be conveniently attached to an air distribution manifold 25 as hereinafter described.

Figure 4:
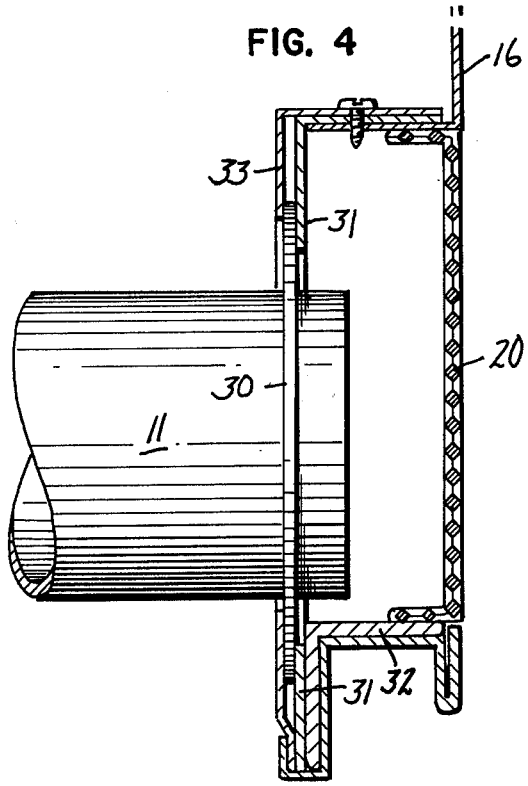
FIG. 4 is an enlarged fragmentary view of the combination grate as shown in FIG. 2 illustrating the method of floating or sliding attachment of a heat exchanger member to the front of the fireplace closure.
Figure 3:
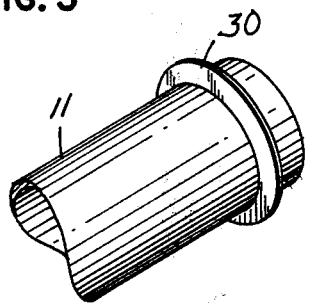
FIG. 3 is a fragmentary view in perspective of one of the heat exchanger members showing an annular collar which forms a part of the sliding or floating seal.

The details of a suitable floating or sliding seal are shown in FIGS. 3 and 4. As shown in FIG. 3, each of the heat exchanger tubes (of which tube 11 is representative) is provided with a radially extending collar or flange 30 which may be circular or square or some other shape. The collar 30 is attached to heat exchanger tube 11 by welding, etc. One convenient method of attachment is to tack-weld collar 30 to tube 11 and then flare the exposed end of tube 11 to force its side wall into a close engagement with the collar 30. During assembly of the combination unit, the heat exchanger tube 11 is positioned so that collar 30 rests against and behind vertically extending support bracket 31 which forms a part of fireplace closure 3 and is reinforced with angle iron 32. The collar is then restrained against rearward movement away from fireplace closure 3 by means of a retaining bracket 33 through which has been cut a series of holes or apertures each of which is somewhat larger in diameter than the outside diameter of heat exchanger tube 11, but which is smaller in diameter than collar 30. Similar holes exist in bracket 31. In this way, as the heat exchanger tubes expand or contract, thereby yawning in response to heat or cold, the collar 30 is free to slide upwardly or downwardly in the restricted space between mounting bracket 31 and retaining bracket 33. However, the collar 30 is prevented from pulling away from closure 3.

Figure 5:
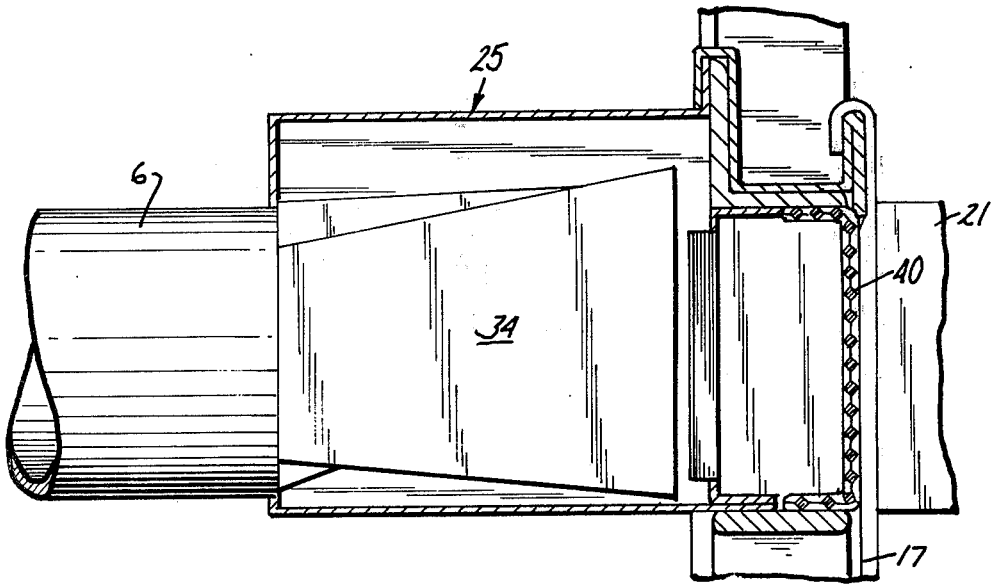
FIG. 5 is an enlarged fragmentary view showing a method of attaching the bottom portion of a heat exchanger member to the lower portion of the fireplace closure.

As shown in FIG. 5, the lower end of each heat exchanger tube (of which tube 6 is representative) is connected (e.g., by welding) to an air distribution manifold 25 which includes a plurality of air directed vanes including vane 34. The purpose of these air directing vanes, which are more clearly shown in FIGS. 6–8, is to direct the flow of air unevenly so that the heat exchanger tubes in the left and right end sections of heat exchanger 2 (when viewed from the room side) receive less air relative to the midsection of heat exchanger 2 than the end sections would receive if the air flow were not controlled or directed by the baffles. The reason for directing more air flow to the midsection of the heat exchanger 2 is because the end sections tend to be heated the least by the fire within the fireplace cavity 24. Consequently, the midsection of the heat exchanger 2 is capable of producing substantially more heated air. Although one might suspect that directing more circulating air through the center section of the heat exchanger 2 would result in uneven distribution of heated air to the room in which the fireplace is located, in practice the heated air tends to diffuse quickly through a room and the non-uniform hot air discharge is not readily apparent. Moreover, the total heat output (i.e., the heating efficiency) of the combination unit is enhanced.

The details of the air distribution manifold 25 are more clearly shown in FIG. 6. As shown in FIG. 6, air is optionally introduced into manifold 25 by means of blower 21 which supplements the natural convective room air which penetrates into manifold 25 through mesh 42. The air flow through manifold 25 is controlled by means of baffles or vanes 34–41 which, together with louvered and slotted panel 43, serve to enhance or direct the flow of air to the centermost heat exchanger tubes and propel a lesser amount of air through the end tubes 4, 5, 10 and 11.

The air directing baffles are more clearly shown in FIG. 7.

In FIGS. 8 and 9 is shown an air distribution manifold 25 to which are attached heat exchanger tubes 4–11. As shown in this alternative embodiment, the open mesh 42 of FIG. 6 has been replaced with a sliding grate or door 44 which permits manual regulation of the amount of natural convective room air which can enter air manifold 25. The ability to restrict and/or eliminate convective room air from manifold 25 is sometimes desirable.

As previously noted, a greater useful heat output can be obtained from the combination grate unit if the center section of the heat exchanger receives more air than it would under normal conditions (e.g., under conditions of unrestricted natural convection). Various methods can be used to achieve this controlled circulation of air including the use of vanes or baffles in the manifold (as previously described), the use of forced air to the center heat exchanger section, only, or the use of zoned air distribution (e.g., by using several blowers and non-overlapping manifolds). Other techniques will suggest themselves to those skilled in this art.

What is claimed is:

1. A combination glass door and heat exchanging grate for fireplaces, said combination unit comprising:
   (a) A ducted heat exchanger suitable for positioning within a fireplace cavity, said heat exchanger including a plurality of hollow, generally parallel C-shaped heat exchanger members having open upper and lower ends, the open ends of which communicate through a glass door fireplace closure;
   (b) a glass door fireplace closure attached to said heat exchanger, at least one end of some of the heat exchanger tubes being attached to said closure through a floating seal so that the tubes can yawn in response to heating or cooling.

2. The combination of claim 1 in which each floating seal comprises a radially extending collar carried by a heat exchanger tube, said collar being restrained between adjacent portions of said fireplace closure to thereby permit limited sliding movement of the collar relative to the fireplace door closure.

3. The combination of claim 2 in which all of said heat exchanger members are tubes which are rigidly attached at their lower ends to the fireplace closure and are attached at their upper ends through a floating seal to said fireplace closure.

4. The combination of claim 3 in which said tubes are made of stainless steel and the lower ends of said tubes are rigidly attached to said fireplace closure.

5. The combination of claim 1 in which the lower ends of said heat exchanger tubes are in communication with an air distribution manifold capable of receiving room air by natural convection, or forced air, or a combination of natural convective air and forced air.

6. A combination glass door and heat exchanging grate for fireplaces, said combination unit comprising:
   (a) A ducted heat exchanger suitable for positioning within a fireplace cavity, said heat exchanger including a plurality of hollow, generally parallel C-shaped heat exchanger members having open upper and lower ends, the open ends of which communicate through a glass door fireplace closure;
   (b) a glass door fireplace closure positioned in front of said heat exchanger; and
   (c) means for directing air into the lower ends of said heat exchanger members so that the center section of the heat exchanger receives more air relative to the end sections of the heat exchanger than the centermost members would receive if the air flow were not controlled.

7. A combination glass door and heat-exchanging grate for fireplaces, said combination unit comprising:
   (a) A ducted heat exchanger suitable for positioning within a fireplace cavity, said heat exchanger including a plurality of hollow, generally parallel C-shaped heat exchanger members having open upper and lower ends, the open ends of which communicate through a glass door fireplace closure;
   (b) a glass door fireplace closure attached to said heat exchanger, at least one end of some of the heat exchanger tubes being attached to said closure through a floating seal so that the tubes can yawn in response to heating or cooling;
   (c) the lower ends of said heat exchanger tubes being in communication with an air distribution manifold capable of receiving room air by natural convection, or forced air, or a combination of natural convective air and forced air; and
   (d) said air distribution manifold including means for directing air so that the heat exchanger tubes in the mid-section of the heat exchanger can receive more air relative to the end sections than the mid-section would receive if the air flow were not controlled.

8. The combination of claim 7 in which the means for directing air includes a series of spaced baffles for intercepting and directing air flow.

9. A combination glass door and heat exchanging grate for fireplaces, said combination unit comprising:
   (a) A ducted heat exchanger suitable for positioning within a fireplace cavity, said heat exchanger including a plurality of hollow, generally parallel C-shaped heat exchanger members each having open upper and lower ends, the open ends of which communicate with room air through a glass door fireplace closure;
   (b) a glass door fireplace closure positioned in front of said heat exchanger; and
   (c) the lower ends of said heat exchanger members being in communication with an air distribution manifold capable of receiving room air by natural convection, or forced air, or a combination of natural convective air and forced air, said air distribution manifold including means for directing forced air so that the heat exchanger members in the mid-section of the heat exchanger receive more air relative to the end sections than the mid-section would receive if the air flow were not controlled.

10. A combination glass door and heat exchanging grate for fireplaces, said combination unit comprising:
   (a) A ducted heat exchanger suitable for positioning within a fireplace cavity, said heat exchanger including a plurality of hollow, generally parallel C-shaped heat exchanger members, the open ends of which communicate through a glass door fireplace closure;
   (b) a glass door fireplace closure positioned in front of said heat exchanger; and
   (c) means for directing air into the lower ends of said heat exchanger members so that the center section of the heat exchanger receives more air relative to the end sections of the heat exchanger than the centermost members would receive if the air flow were not controlled, said means comprising a plurality of air directing baffles spaced within an air manifold.

11. The combination of claim 10 in which the heat exchanger members are stainless steel tubes the lower ends of which are welded to the air manifold and the upper ends of which are secured to the fireplace closure through a floating or sliding seal in which each seal comprises a radially extending collar carried by each heat exchanger tube, said collar being restrained between adjacent portions of said fireplace closure to thereby permit limited sliding movement of the collar relative to the fireplace door closure.

12. The combination of claim 11 in which air is supplied to the manifold by means of natural convection and a variable speed blower.

13. The combination of claim 12 which further includes:

(a) a combination draft regulator/ash-door located in the closure below the air manifold; and (b) a screen or grid positioned over the upper or exhaust ends of the heat exchanger tubes.

* * * * *